US005326300A

United States Patent [19]

Sonders

[11] Patent Number: 5,326,300

[45] Date of Patent: Jul. 5, 1994

[54] COMBINATION CARRYING DEVICE AND TOY

[76] Inventor: Scott Sonders, 15445 Ventura Blvd. #279, Sherman Oaks, Calif. 91403

[21] Appl. No.: 18,061

[22] Filed: Feb. 16, 1993

[51] Int. Cl.[5] ..... A63H 3/00; A45C 15/00

[52] U.S. Cl. ..... 446/74; 446/369; 224/151; 190/1

[58] Field of Search ..... 446/72-74, 446/369, 390; 190/1, 2; 224/151, 153; 206/457; 383/4; 5/420, 424

[56] References Cited

U.S. PATENT DOCUMENTS

| | | | |
|---|---|---|---|
| D. 155,742 | 10/1949 | Shevis . | |
| D. 282,189 | 1/1986 | Williams et al. | D21/159 |
| D. 296,955 | 8/1988 | Janney et al. . | |
| 1,638,594 | 8/1927 | Myers | 446/74 X |
| 2,908,020 | 10/1959 | Barton . | |
| 3,831,313 | 8/1974 | Cichy | 446/369 X |
| 3,977,121 | 8/1976 | Goldfarb et al. . | |
| 4,068,786 | 1/1978 | Taniguchi . | |
| 4,563,159 | 1/1986 | Hills et al. . | |
| 4,566,130 | 1/1986 | Coates . | |
| 4,606,087 | 8/1986 | Alivizatos | 190/2 X |
| 4,662,550 | 5/1987 | O'Donnell | 224/153 X |
| 4,754,512 | 7/1988 | Chen | 5/482 |
| 4,781,277 | 11/1988 | Lim | 190/1 |
| 4,822,285 | 4/1989 | Summerville | 446/369 X |
| 4,886,150 | 12/1989 | Fitzsimmons | 190/1 |
| 4,889,512 | 12/1989 | Burnett et al. | 446/72 |

FOREIGN PATENT DOCUMENTS

| | | | |
|---|---|---|---|
| 678702 | 1/1964 | Canada | 446/73 |

*Primary Examiner*—Mickey Yu

[57] ABSTRACT

A combination carrying device and toy including a body having an exterior surface defining a toy-like structure and having interior surfaces defining at least one hollow body cavity being sufficiently sized to contain and carry desired baby accessories. At least one entry panel forms a portion of the exterior surface, the entry panel providing access to the hollow body cavity. The entry panel is fastened in a desired orientation relative to the exterior surface. Preferably, the body is in the shape of an ostensibly stuffed animal, such as a bear.

16 Claims, 2 Drawing Sheets

COMBINATION CARRYING DEVICE AND TOY

BACKGROUND OF THE INVENTION

1. Field of the Invention

The present invention relates to carrying devices and toys and more particularly to an ostensibly stuffed toy animal which serves as a carrying device for infant accessories and is convertible to an infant changing pad.

2. Description of the Related Art

Parents, while travelling with an infant, typically have a difficult time as a result of the quantity of items which must be carried to care for the infant. The types of infant accessories vary in a wide range and include, for example, diapers, bibs, formula bottles, changing pads, baby wipes, baby blankets, feeding equipment and child toys.

Generally, heretofore, these infant accessories have been carried by large tote bags and the like. For example, U.S. Pat. No. 4,886,150, issued on Dec. 12, 1989, discloses a baby's accessory carrier which includes an elongated, rectangular panel with a central, transversely extending change area covered by a releasable impermeable pad and bordered by a pair of pocket-containing ends, which are folded into an overlapping relationship with each other and with the change area to form a small, rectangular package. The package is folded double to form a compact, purse-like article.

U.S. Pat. No. 4,566,130, issued on Jan. 21, 1986, discloses a combination carrying bag for infant accessories and a diapering station formed of a single piece of material divided by fold lines into three successive sections to cushion an infant on a support surface and store infant accessories for diapering changing. The diapering station is converted into a carrying bag for infant accessories.

U.S. Pat. No. 4,781,277, issued on Nov. 1, 1988, discloses a diaper changing bag made from a soft quilted plastic material comprising two closeable storage compartments connected at their undersides by a mat in which the baby being changed is placed. Foldable end flaps support the baby's head and legs, respectively. Nappies or diapers and ointments can be stored in the compartments and feeding bottles in wells provided in the end of one of the compartments.

U.S. Pat. No. 2,908,020, issued on Oct. 13, 1959, discloses a diaper bag that folds out into a baby bed. U.S. Pat. No. 4,086,786, issued on Jan. 17, 1978, discloses another implementation of a baby bag.

By contrast to the above various infant accessory carrying devices, the following are examples of children's toy figures that may have additional utility.

U.S. Pat. No. 4,889,512, issued on Dec. 26, 1989, discloses a soft sculptural human-figured doll with a carrying strap. The doll may be used as a child's pillow.

U.S. Design Pat. No. 155,742 discloses a design for a children's purse in the shape of a bear with no substantial thickness. U.S. Pat. No. 3,977,121, issued on Aug. 31, 1976, discloses a doll with an unfixed shape that, by means of ties, can be arranged into various shapes.

U.S. Design Pat. No. 181,189 discloses a design for a toy bear figure with a back pack. U.S. Design Pat. No. 296,955, issued on Aug. 2, 1988, discloses an athletic tote bag with an ornamental animal fascia.

U.S. Pat. No. 4,563,159, issued on Jan. 7, 1986, disclosed a potentially multiple configured toy that may be concealed in a tote bag. U.S. Pat. No. 4,754,512 discloses an animal-shaped toy with an attached blanket roll and inflatable pillow.

As will be disclosed below, the present invention combines the advantages of most of the previously discussed prior art by providing a device which efficiently and simultaneously carries numerous infant accessories. The present invention additionally and coincidentally serves as a child's toy configured as an ostensibly stuffed animal, which may further be reconfigured into an infant's bedding device and/or changing pad.

SUMMARY OF THE INVENTION

The present invention is a combination carrying device and toy which, in a broad aspect, comprises a body having an exterior surface defining a toy-like structure and having interior surfaces defining at least one hollow body cavity being sufficiently sized to contain and carry desired baby accessories. At least one entry panel forms a portion of the exterior surface, the entry panel providing access to the hollow body cavity. Means are provided for fastening the entry panel in a desired orientation relative to the exterior surface. Preferably, the body is in the shape of an ostensibly stuffed animal such as a bear. Furthermore, it is preferred that the body cavity define a central body cavity and leg cavities. It is also preferred that the entry panel comprises a single anterior central body cavity flap securable by side zippers and VELCRO TM.

In summation, the present invention may be utilized and function as (1) a child's toy and ostensibly stuffed animal (2) a diaper tote bag (3) a baby changing pad (4) an infant's bedding (5) an infant's formula bottle carrier, and (6) a diaper storage "cozy" or coverlet. Through these multiple functions, all existing in a single combination carrying device and toy, the problem of a mobile parent being burdened with many infant accessories and necessities is conveniently and efficiently solved.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENT

Figure 1:
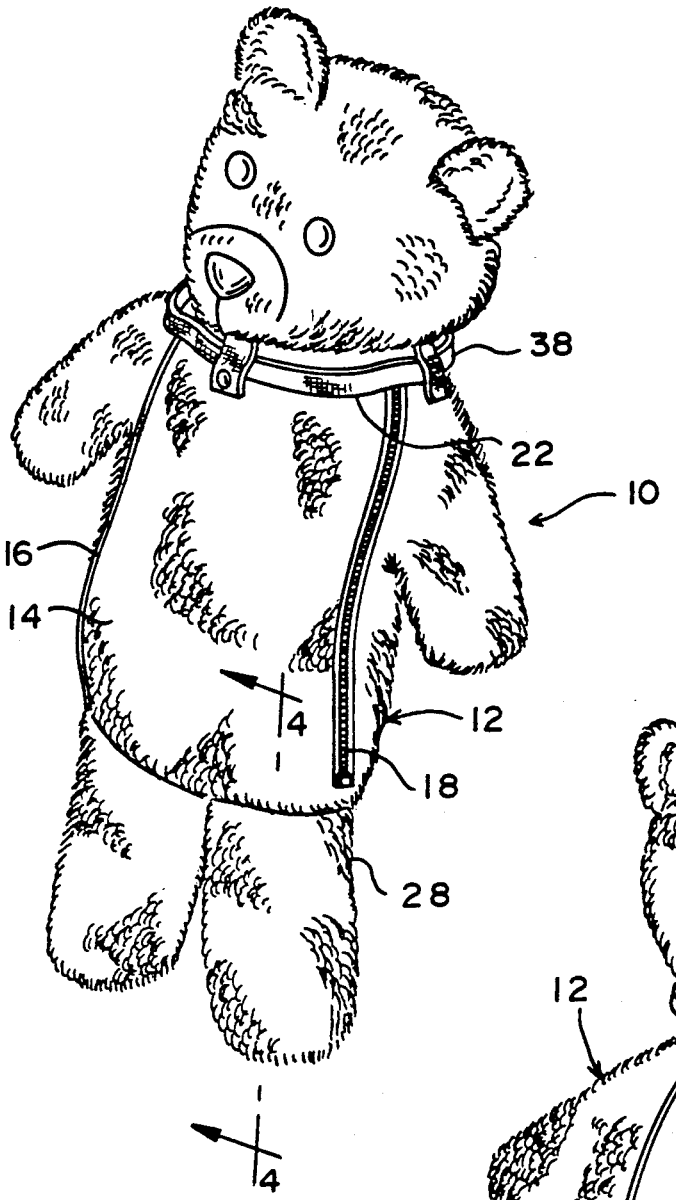
FIG. 1 is a front, top and side perspective view of the combination carrying device and toy of the present invention.
Figure 2:
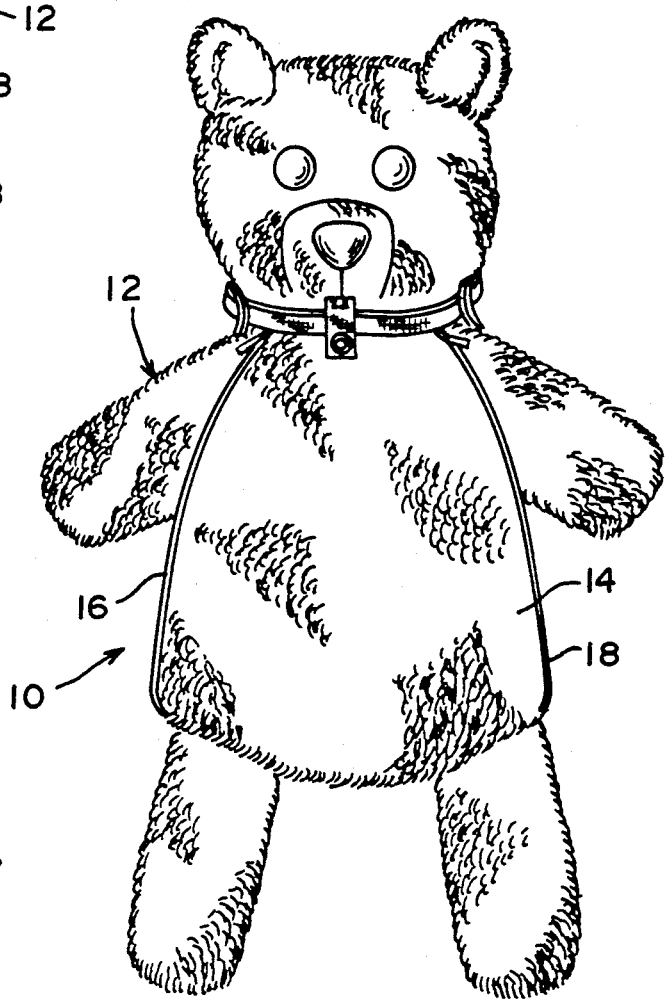
FIG. 2 is a front perspective view of the carrying device and toy.

Referring to the drawings and the characters of reference marked thereon, FIGS. 1 and 2 illustrate perspective views of a preferred embodiment of the present invention, designated generally as 10. The invention comprises a body 12 having an exterior surface defining a toy-like structure such as an ostensibly stuffed animal, particularly a bear. An anterior central body cavity flap or entry panel 14 forms a portion of this exterior surface. The entry panel 14 is fastened in its desired orientation by two substantially vertical opposed side zippers 16, 18.

Figure 3:
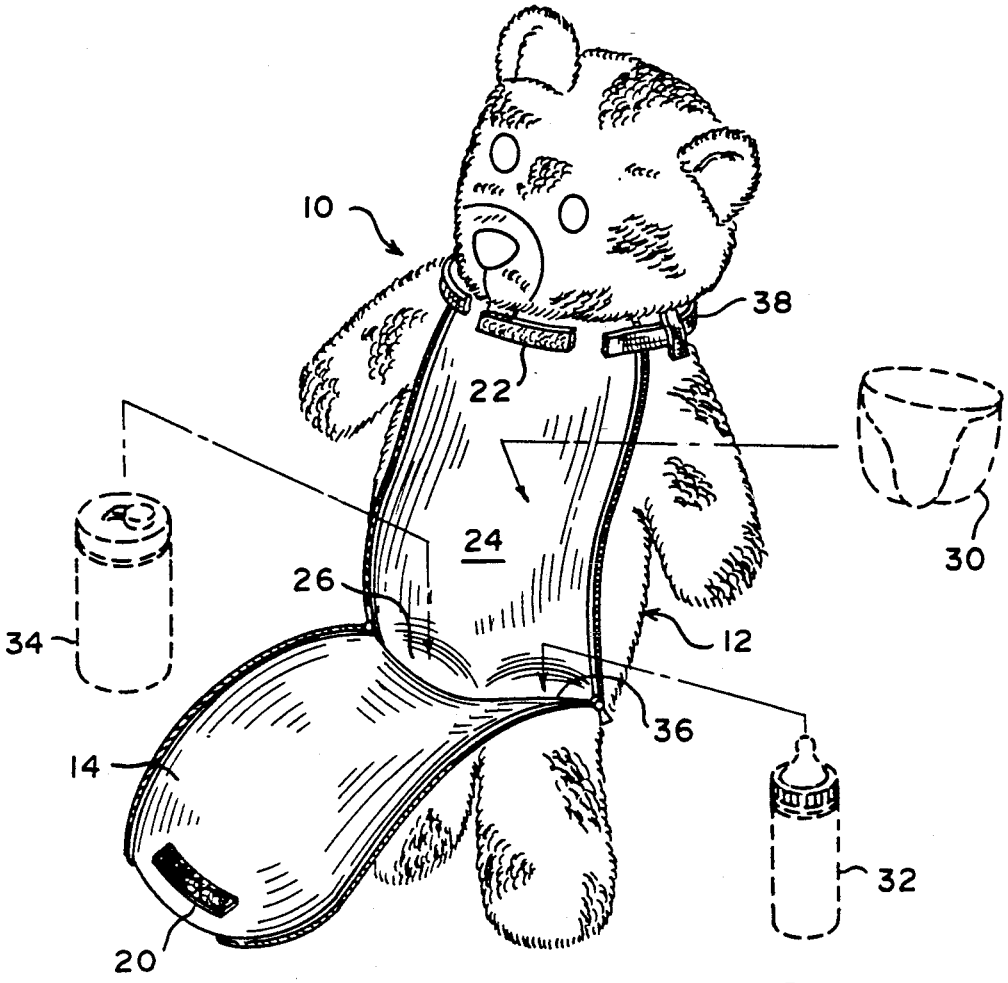
FIG. 3 illustrates the entry panel in an opened position to provide access to infant accessories which are shown in phantom.

As can be seen in FIG. 3, the top of the entry panel 14 is secured by two pieces 20, 22 of synthetic material of the type that adheres when pressed together with a complementary piece of such synthetic material, marketed under the trademark VELCRO TM. Zippers 16, 18 are preferably of a non-snagging or rip-stop type, and are also preferably formed of a non-metallic material such as a TEFLON TM based material.

As can be seen clearly in FIG. 3, when the entry panel 14 is opened, access is provided to a central hollow body cavity 24 and to leg or appendage cavities 26 formed in legs 28. Central body cavity 24 is perfect for storing baby accessories such as diapers 30, baby blankets and/or baby wipes. The leg cavities 26 are conveniently sized to secure baby bottles 32 or other similarly shaped food containers 34. The entry panel 14 preferably commences at a substantially horizontal crease line 36 at a location immediately above the legs so that when the entry panel 14 is opened and laid flat an infant bedding device is configured.

The head and arms are preferably stuffed with soft foam material. As such, the head may be conveniently utilized as a pillow.

Additionally, the device 10 has a decorative collar 38 which ay serve as a carrying strap. The collar 38 is shown broken away in FIG. 3.

Figure 4:
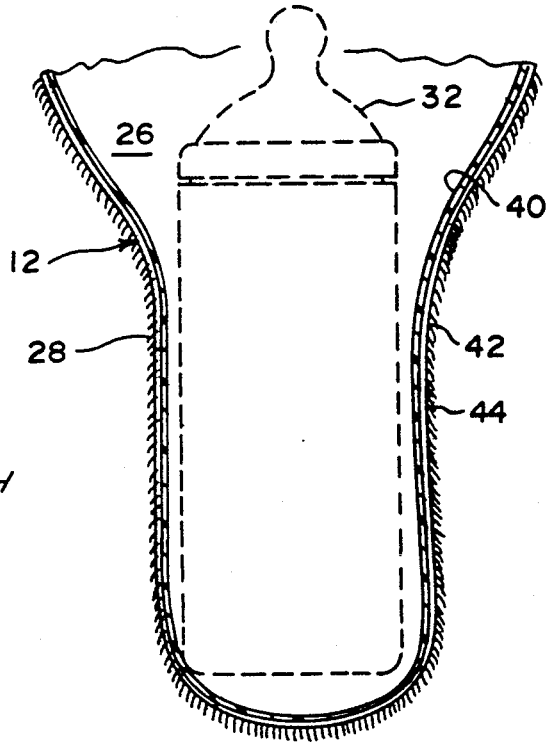
FIG. 4 is a cross-sectional view of the device and toy, taken along line 4—4 of FIG. 1.

Referring now to FIG. 4, a cross-sectional view illustrates a bottle 32 within a leg cavity 26. Additionally, this figure also illustrates the preferred combination of layers forming the body 12. An inner layer 40 is formed of moisture resistant material such as a light-gauge vinyl fabric. This allows the convenient use of the device 10 as an infant changing pad and also allows the material to be wiped clean if there is leakage in the baby bottle or other fluid containers. Conventional synthetic fabric batting 42 or other natural insulating fabric is utilized to support an outer layer of synthetic fur fabric 44, such as that marketed by Monsanto under the trademark ACRYLON TM.

Obviously, many modifications and variations of the present invention are possible in light of the above teachings. For example, only the torso and legs of the device 10 are shown to define cavities. It is noted that, if desired, the arms could also be designed to contain infant accessories.

Although the principles of the present invention have been illustrated in application to a bear's shape, it is understood that such a shape has been shown by way of illustration and not limitation. The body may be shaped like other stuffed animals or other shapes which are "toy-like," that is, a shape which provides amusement for children and/or infants. It is also noted that the term "ostensible" has been used to emphasize the fact that the device is shaped to appear as an "apparent" stuffed animal although it serves to function as a carrying device.

What is claimed and desired to be secured by Letters Patent of the United States is:

1. A combination carrying device and toy, comprising:

a) a body having an exterior surface defining a toy-like structure and having interior surfaces defining a plurality of hollow body cavities being sufficiently sized to contain and carry desired baby accessories, said plurality of hollow body cavities comprising at least one body cavity defining a central body cavity and appendage cavities in appendages of said body, said appendages defining legs, leg cavities defined therein for containing infant formula bottles;

b) at least one entry panel forming a portion of said exterior surface, said entry panel providing access to said central body cavity; and, c) means for fastening said entry panel in a desired orientation relative to said exterior surface.

2. The combination carry device and toy of claim 1, wherein said means for fastening said entry panel comprises at least one piece of synthetic material of the type that adheres when pressed together with a complementary piece of said synthetic material.

3. The combination carrying device and toy of claim 1, wherein said body defines an ostensibly stuffed animal having a decorative collar which also functions as a carrying strap.

4. The combination carrying device and toy of claim 1, wherein said body defines an ostensibly stuffed miniature bear.

5. The combination carrying device and toy of claim 1, wherein said body defines an ostensibly stuffed animal, the head thereof defining a pillow.

6. The combination carrying device and toy of claim 1, wherein said interior surfaces defining said central body cavity reconfigure when said at least one entry panel is opened and laid flat so as to form an infant bedding device.

7. The combination carrying device and toy of claim 1, wherein said interior surfaces defining said central body cavity are formed of moisture resistant material and reconfigure when said at least one entry panel is opened and laid flat so as to form an infant changing pad.

8. The combination carrying device and toy of claim 1, wherein said means for fastening said entry panel comprises at least one zipper.

9. The combination carrying device and toy of claim 1, wherein said body defines an ostensibly stuffed animal, said at least one entry panel comprising a single central body cavity flap.

10. The combination carrying device and toy of claim 1, wherein said body defines an ostensibly stuffed animal, said at least one entry panel comprising a single anterior central body cavity flap.

11. The combination carrying device and toy of claim 10, wherein said means for fastening said single anterior central body cavity flap comprises two substantially vertical opposed side zippers located on each respective side of said central body cavity.

12. A combination carrying device and toy, comprising:

a) a body having an exterior surface defining a toy-like structure and having interior surfaces defining at least one hollow body cavity being sufficiently sized to contain and carry desired baby accessories;

b) at least one entry panel forming a portion of said exterior surface, said entry panel providing access to said at least one hollow body cavity; and, c) means for fastening said entry panel in a desired orientation relative to said exterior surface, wherein said body defines an ostensibly stuffed animal having legs, said at least one entry panel comprising a single central body cavity flap commencing at a substantially horizontal crease line at a location immediately above said legs, wherein said interior surfaces defining said hollow body cavity reconfigure when said at least one central body cavity flap is opened and laid flat so as to form an infant bedding device.

13. The combination carrying device and toy of claim 12, wherein said central body cavity flap comprises a single anterior central body cavity flap.

14. The combination carrying device and toy of claim 13, wherein said means for fastening said single anterior central body cavity flap comprises two substantially vertical opposed side zippers located on each respective side of said central body cavity.

15. The combination carrying device and toy of claim 14, wherein said means for fastening said single anterior central body cavity flap further comprises at least one piece of synthetic material of the type that adheres when pressed together with a complementary piece of said synthetic material.

16. The combination carrying device and toy of claim 15, wherein said synthetic material is positioned at a collar of said stuffed animal.

* * * * *